US010314112B2

(12) United States Patent
Swanson

(10) Patent No.: US 10,314,112 B2
(45) Date of Patent: Jun. 4, 2019

(54) SELF-REGULATING PACKED-POWDER RESISTIVE HEATER

(71) Applicant: SPAWAR Systems Center Pacific, San Diego, CA (US)

(72) Inventor: Paul David Swanson, Santee, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 459 days.

(21) Appl. No.: 15/343,961

(22) Filed: Nov. 4, 2016

(65) Prior Publication Data

US 2017/0135154 A1 May 11, 2017

Related U.S. Application Data

(60) Provisional application No. 62/252,148, filed on Nov. 6, 2015.

(51) Int. Cl.

| | |
|---|---|
| ***H05B 3/14*** | (2006.01) |
| ***H05B 3/60*** | (2006.01) |
| ***H05B 3/00*** | (2006.01) |

(52) U.S. Cl.

CPC ..... *H05B 3/145* (2013.01); *H05B 3/0004* (2013.01); *H05B 3/0023* (2013.01); *H05B 3/60* (2013.01); *H05B 2203/009* (2013.01)

(58) Field of Classification Search

CPC .... H05B 3/145; H05B 3/0004; H05B 3/0023; H05B 3/023; H05B 3/60; H05B 3/0095; H05B 3/283; H05B 3/42; H05B 3/44; H05B 3/46; H05B 3/48; H05B 3/52; H05B 3/40; H05B 3/56; H05B 3/565; H05B 3/58; H05B 3/141; H05B 2203/009; H05B 2203/012; H05B 2203/01; H05B 2203/011; H05B 2203/017; H05B 2203/02; H05B 2203/021; H05B 1/0291; B29C 2045/2746; B29C 2045/2751; H01C 1/1406; H01C 1/146; H01C 1/148; H01C 1/142; H01C 1/144; H01C 17/00; H01C 17/02; H01B 7/1875; H01B 7/1895; H01B 7/205; H01B 7/42; H01B 7/428

See application file for complete search history.

(56) References Cited

U.S. PATENT DOCUMENTS

| | | | |
|---|---|---|---|
| 2,883,307 | A | 4/1959 | Orr, Jr. |
| 3,025,385 | A | 3/1962 | Tanaka |
| 4,922,082 | A | 5/1990 | Bredt et al. |

OTHER PUBLICATIONS

Sanchez-Gonzalez, Jose et al.; Electrical conductivity of carbon blacks under compression; Article in Carbon Elsevier; Dec. 2005.

*Primary Examiner* — Shawntina T Fuqua
(74) *Attorney, Agent, or Firm* — NWC Pacific; Kyle Eppele; J. Eric Anderson

(57) ABSTRACT

A heater comprising: an outer tube having a first thermal expansion coefficient; an inner tube having a second thermal expansion coefficient that is less than the first thermal expansion coefficient, wherein the inner tube is disposed concentrically with the outer tube such that there is a space between the inner and outer tubes; a conductive powder disposed within the space between the inner and outer tubes; and two electrodes in electrical contact with the conductive powder such that when a potential is introduced between the electrodes, the conductive powder functions as a resistive heater whose resistance changes with temperature based on different degrees of thermal expansion of the inner and outer tubes.

12 Claims, 3 Drawing Sheets

SELF-REGULATING PACKED-POWDER RESISTIVE HEATER

CROSS-REFERENCE TO RELATED APPLICATION

This application claims the benefit of U.S. Provisional Application No. 62/252,148 filed 6 Nov. 2015, titled "Self-Regulating Packed Powder Resistive Heater" (Navy Case #103640).

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 103540.

BACKGROUND OF THE INVENTION

This invention relates to the field of resistive heaters.

SUMMARY

Disclosed herein is a heater comprising an outer tube, an inner tube, a conductive powder, and two electrodes. The outer tube has a first thermal expansion coefficient and the inner tube has a second thermal expansion coefficient that is less than the first thermal expansion coefficient. The inner tube is disposed concentrically with the outer tube such that there is a space between the inner and outer tubes where the conductive powder is disposed. The two electrodes are in electrical contact with the conductive powder such that when a potential is introduced between the electrodes, the conductive powder functions as a resistive heater whose resistance changes with temperature based on different degrees of thermal expansion of the inner and outer tubes.

The heater disclosed herein may be used in a method for heating comprising the following steps. The first step involves providing the concentric inner and outer tubes having different thermal expansion coefficients. The next step provides for packing the space between the inner and outer tubes with the conductive powder. The next step provides for providing the two electrodes in electrical contact with the conductive powder. The next step provides for introducing a potential across the electrodes such that the conductive powder functions as a resistive heater whose resistance changes with temperature based on different degrees of thermal expansion of the inner and outer tubes.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1A:
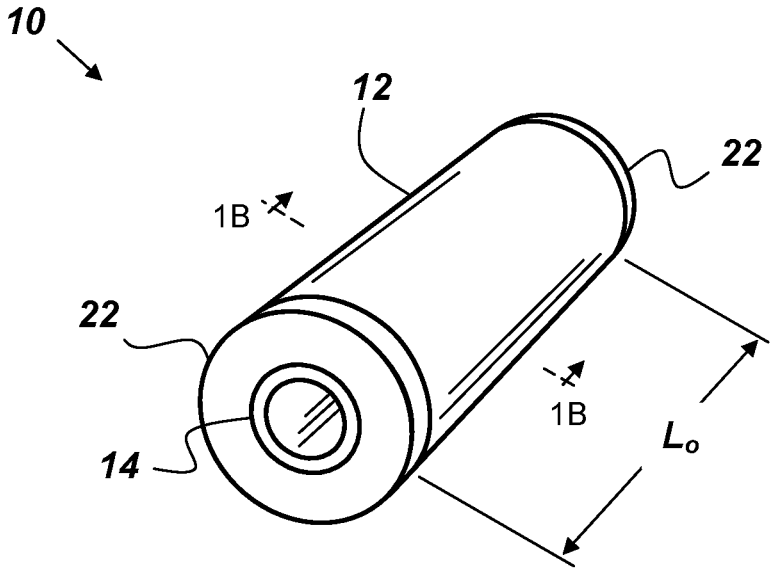
FIGS. 1A and 1B are respectively perspective and cross-sectional views of a resistive heater.
Figure 1B:
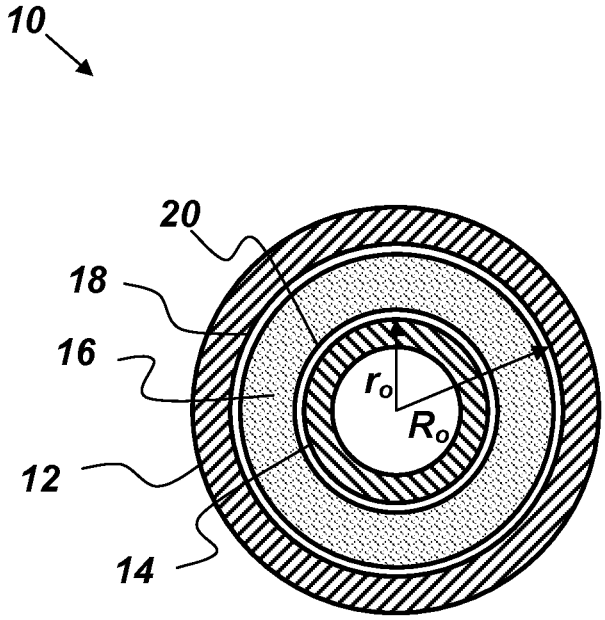

FIGS. 1A and 1B are illustrations of a self-regulating, packed-powder, resistive heater, hereinafter referred to as resistive heater 10 that automatically and gradually reduces the input power of the heater as the temperature increases. FIGS. 1A and 1B are respectively perspective and cross-sectional views of the resistive heater 10. Resistive heater 10 comprises, consists of, or consists essentially of an outer tube 12, and inner tube 14, a conductive powder 16, and first and second electrodes 18 and 20. The resistance of the resistive heater 10 changes with temperature based on differing thermal expansion coefficients of the outer tube 12, and inner tube 14. The outer tube 12 has a thermal expansion coefficient that is larger than the thermal expansion coefficient of the inner tube 14. The outer and inner tubes 12 and 14 are concentrically disposed with respect to each other. The diameters of the outer and inner tubes 12 and 14 are such that there is a space between the inner and outer tubes 14 and 12. The conductive powder 16 is packed into the space between the inner and outer tubes 14 and 12. The first electrode 18 in the embodiment of the resistive heater 10 shown in FIGS. 1A and 1B is a conductive metal coating on the inner surface of the outer tube 12. The second electrode 20 in the embodiment of the resistive heater 10 shown in FIGS. 1A and 1B is a conductive metal coating on the outer surface of the inner tube 14. Both electrodes 18 and 20 are in electrical contact with the conductive powder 16 such that when a potential is introduced between the electrodes 18 and 20, the conductive powder 16 functions as a resistive heater whose resistance changes with temperature based on different degrees of thermal expansion of the inner and outer tubes 14 and 12. The space between the inner and outer tubes 14 and 12 may be sealed with ceramic end caps 22.

The conductive powder 16 functions as a variable resistor. Heat is generated as a function of the degree to which the conductive powder 16 resists current flow. As the heat increases, the inner tube 14 expands at a slower rate than the outer tube 12 which decreases the degree to which the conductive powder 16 is compressed between the inner and outer tubes 14 and 12. As the conductive powder 16 becomes less compressed its resistivity increases, which in turn decreases the temperature generated by the resistive heater 10. The heat generated by the resistive heater 10 is proportional to the power (P) dissipated through the device given by the known equation:

$$P = IV = I^2R = \frac{V^2}{R} \tag{1}$$

Where R is the resistance of the conductive powder 16 packed between the inner and outer tubes 14 and 12, I is the current going through the conductive powder 16, and V is the voltage across the resistive heater 10 (i.e., the voltage difference between the $1^{st}$ and $2^{nd}$ electrodes 18 and 20). If the inner tube 14 has a lower thermal expansion coefficient than the outer tube 12, the resistance of the powder 16 will increase as the tubes get hotter. If the inner tube 14 has a higher thermal expansion coefficient then the outer tube 12, than the resistance will decrease as the tubes get hotter.

The resistive heater 10 will typically be powered by an approximately-constant-voltage power source (not shown) such that, based on equation (1) above, the resistive heater 10 will generate less heat when the resistance increases. If the power source provides approximately-constant current, the resistive heater 10 will generate more heat when the resistance increases. Most power sources known in the art provide constant peak voltage, either alternating current (AC) or direct current (DC). Suitable examples of an approximately-constant-voltage power source include, but are not limited to, AC mains electricity, such as is commonly used in households and businesses to power electric devices; and DC battery power.

The inner and outer tubes 14 and 12 may be any ceramic tube having any desired size and/or shape. For example, in the embodiment of the resistive heater 10 shown in FIGS. 1A and 1B, the inner and outer tubes 14 and 12 are cylinders. However, it is to be understood that the inner and outer tubes 14 and 12 are not limited to cylinders, but may have any desired cross-sectional shape and size, and may have any desired length. The conductive powder 16 may be any conductive powder capable of being packed between the inner and outer tubes 14 and 12. A suitable example of the conductive powder 16 includes, but is not limited to, carbon black. The variation of conductivity with compression of carbon black has been well studied and documented. (See, for example J. Sánchez-González et al., "Electrical conductivity of carbon blacks under compression"/Carbon 43 (2005) 741-747, referred to hereafter as Sánchez-González, which is incorporated by reference herein.)

In operation, the conductive powder 16 between the inner and outer tubes 14 and 12 forms an analog, negative feedback mechanism that automatically alters the input power of the resistive heater 10 as the temperature of the resistive heater 10 changes. Analog fail safe control systems using negative feedback mechanisms are adherently safer than digital control systems since they do not rely on any other system to function. Thermal fuses and circuit breakers are good examples of such fail safe control systems; however their feedback response is an abrupt shut down when a designated peak condition is reached. In contrast, the resistive heater 10 is a self-regulating heating element whose resistance changes gradually with temperature based on differing thermal expansion coefficients of the inner and outer tubes 14 and 12.

The conductive powder 16 is electrically contacted by the $1^{st}$ and $2^{nd}$ electrodes 18 and 20. The volume V between the inner and outer tubes 14 and 12 at a temperature $T_o+\Delta T$ is given by:

$$V=L_o\times(1+\Delta T\times A)\times(\pi(R_o\times(1+\Delta T\times A))^2-\pi(r_o\times(1+\Delta T\times a))^2) \quad (2)$$

where $L_o$, $R_o$, and $r_o$, respectively are the length of the outer tube 12, the inner radius of the outer tube 12, and the outer radius of the inner tube 14 at temperature $T_o+\Delta T$, while A and a are the thermal expansion coefficients of the outer tube 12 and inner tube 14, respectively. As documented in Sánchez-González, the conductance a of powdered carbon black changes significantly with the change of volume of the powdered carbon. With a constant voltage source V the, heat output power P may be given by $P=\sigma V^2$. The change in volume of the resistive heater 10 over a given temperature range can be engineered by choosing the proper materials and dimensions of the conductive powder 16 and the inner and outer tubes 14 and 12. Table 1 below gives the coefficients of linear expansion and maximum operating temperature of various ceramic materials that may be used to construct the inner and outer tubes 14 and 12.

TABLE 1

Coefficients of linear expansion and maximum operating temperature of various ceramics

| Ceramic | Coefficient of Linear Thermal Expansion (μm/m-° C.) | Maximum Temperature (° C.) |
|---|---|---|
| $Al_2O_3$ | 8.4 | 1750 |
| AlN | 4.6-5.7 | 1600 |
| $B_4C$ | 5.54 | 2450 |
| BN | 1.0-2.0 | 985 |
| Cordierite | 1.7 | 1371 |
| Graphite | 8.39 | 3650 |
| Mullite | 5.3 | 1700 |
| Sapphire | 7.9-8.8 | 2000 |
| SiC | 5.12 | 1400 |
| $Si_3N_4$ | 3.4 | 1500 |
| Steatite L-5 | 7 | 1425 |
| $TiB_2$ | 7.4-9.8 | 2000 |
| WC | 5.9 | ng |
| ZrO2 | 11 | 500 |

Figure 2:
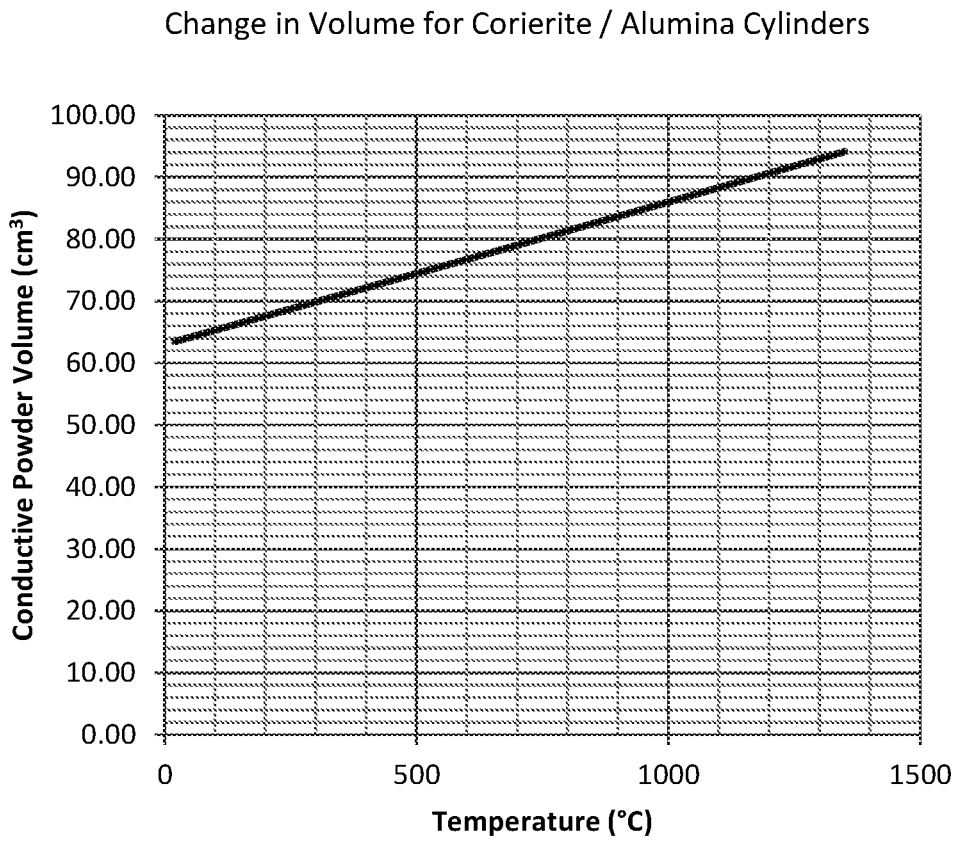
FIG. 2 is a graphical plot showing the change in volume of conductive powder over a temperature range of approximately 1500° C.

FIG. 2 is a graphical plot showing the change in volume of the conductive powder 16 over a temperature range of approximately 1500° C. for an example embodiment of the resistive heater 10. In this example embodiment, the inner tube 14 is a Cordierite cylinder that has a length of 20.0 cm and an outer diameter of 5.0 cm; and the outer tube 12 is an Alumina ($Al_2O_3$) cylinder that has a length of 20.0 cm and an inner diameter of 5.1 cm. The resistive heater 10 can operate at very high temperatures (e.g., ~2000° C.).

Figure 3A:
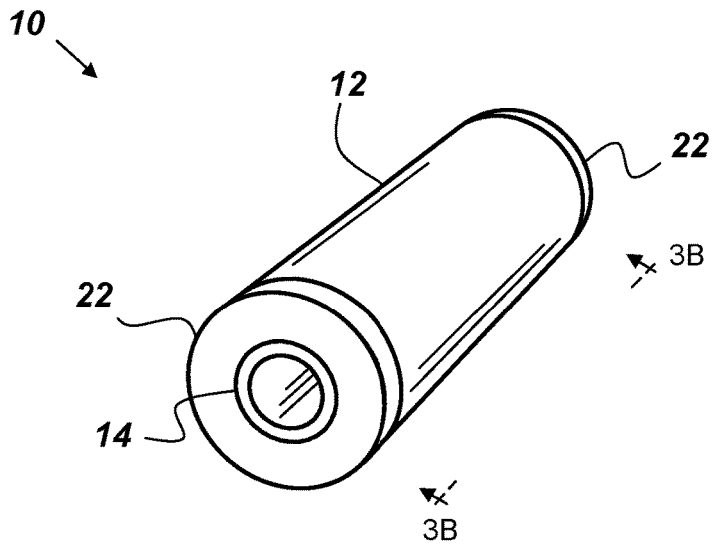
FIGS. 3A and 3B are respectively perspective and cross-sectional views of a resistive heater.
Figure 3B:
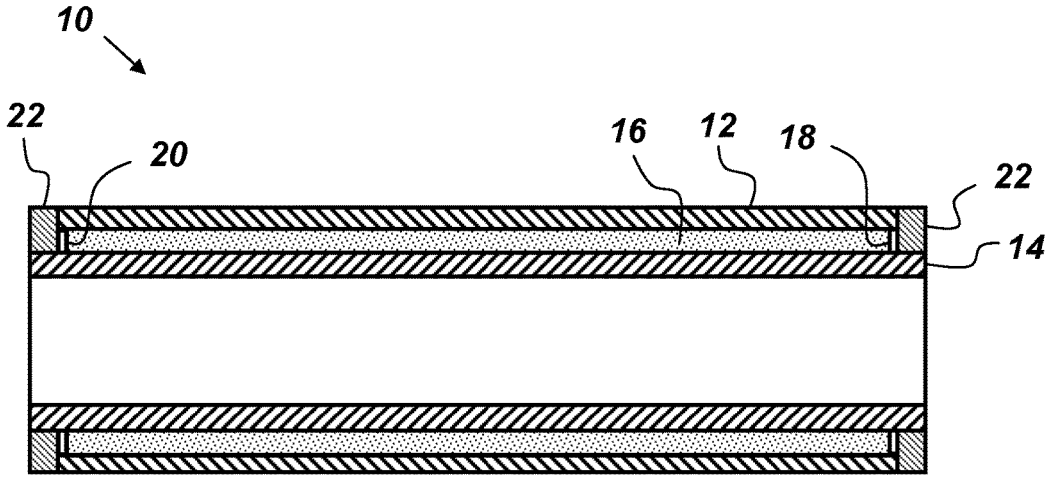

FIGS. 3A and 3B are respectively perspective and cross-sectional views of another embodiment of the resistive heater 10. In this embodiment (i.e., the one shown in FIGS. 3A and 3B), the first and second electrodes 18 and 20 are annular rings made of conductive material disposed at opposing ends of the inner and outer tubes 14 and 12. The means of connecting the conductive powder 16 to a power source is not limited to the opposing annular ring electrodes shown in FIGS. 3A and 3B or the radially-separated metal coatings shown in FIGS. 1A and 1B, but the conductive powder 16 may be connected to the power source by any means known in the art. In another example, the electrodes 18 and 20 may be electrodes submersed in the conductive powder 16 in the space between, and on opposing ends of, the inner and outer tubes 14 and 12.

From the above description of the resistive heater 10, it is manifest that various techniques may be used for implementing the concepts of resistive heater 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that resistive heater 10 is not limited to the particular embodiments described herein, but is capable of many embodiments without departing from the scope of the claims.

I claim:

1. A heater comprising:

an outer tube having a first thermal expansion coefficient;

an inner tube having a second thermal expansion coefficient that is less than the first thermal expansion coefficient, wherein the inner tube is disposed concentrically with the outer tube such that there is a space between the inner and outer tubes;

a conductive powder disposed within the space between the inner and outer tubes; and two electrodes in electrical contact with the conductive powder such that when a potential is introduced between the electrodes, the conductive powder functions as a resistive heater whose resistance changes with temperature based on different degrees of thermal expansion of the inner and outer tubes.

2. The heater of claim 1, wherein the conductive powder is carbon black.

3. The heater of claim 2, wherein the inner and outer tubes are ceramic.

4. The heater of claim 3, wherein the inner tube is made of Cordierite and the outer tube is made of Alumina.

5. The heater of claim 4, wherein the distance between an outer surface of the inner tube and an inner surface of the outer tube is approximately 1 mm.

6. The heater of claim 1, wherein the electrodes are submersed in the conductive powder at opposite ends of the concentric tubes.

7. The heater of claim 1, wherein one of the electrodes is a conductive metal coating on an outer surface of the inner tube and the other electrode is a conductive metal coating on an inner surface of the outer tube.

8. The heater of claim 1, wherein the conductive powder is configured to heat up to approximately 2000° C.

9. The heater of claim 1, wherein the inner and outer tubes are cylinders.

10. A method for heating comprising the steps of:

providing concentric inner and outer tubes having different thermal expansion coefficients;

packing a space between the inner and outer tubes with a conductive powder;

providing two electrodes in electrical contact with the conductive powder;

introducing a potential across the electrodes such that the conductive powder functions as a resistive heater whose resistance changes with temperature based on different degrees of thermal expansion of the inner and outer tubes.

11. A resistive heater comprising:

an outer tube having an inner surface and a first thermal expansion coefficient;

an inner tube having an outer surface a second thermal expansion coefficient that is less than the first thermal expansion coefficient, wherein the inner tube is disposed concentrically with the outer tube such that there is a space between the outer surface of the inner tube and the inner surface of the outer tube;

carbon black powder disposed within the space between the inner and outer tubes and packed sufficiently such that the carbon black powder is conductive; and two electrodes in electrical contact with the carbon black powder such that when a potential is introduced between the electrodes, the carbon black powder functions as a resistive heater whose resistance changes with temperature based on the different degrees of thermal expansion of the inner and outer tubes.

12. The resistive heater of claim 11, wherein the inner tube has an outer radius of 5.0 cm and the outer tube has an inner radius of 5.1 cm.

* * * * *